US009591414B2

(12) United States Patent
Ikeda

(10) Patent No.: US 9,591,414 B2
(45) Date of Patent: Mar. 7, 2017

(54) ACOUSTIC DEVICE

(71) Applicant: KYOCERA CORPORATION, Kyoto (JP)

(72) Inventor: Tomoyoshi Ikeda, Yokohama (JP)

(73) Assignee: KYOCERA Corporation, Kyoto (JP)

( * ) Notice: Subject to any disclaimer, the term of this patent is extended or adjusted under 35 U.S.C. 154(b) by 0 days.

(21) Appl. No.: 14/786,803

(22) PCT Filed: Apr. 24, 2014

(86) PCT No.: PCT/JP2014/002318
§ 371 (c)(1),
(2) Date: Oct. 23, 2015

(87) PCT Pub. No.: WO2014/174850
PCT Pub. Date: Oct. 30, 2014

(65) Prior Publication Data

US 2016/0182993 A1 Jun. 23, 2016

(30) Foreign Application Priority Data

Apr. 26, 2013 (JP) ..... 2013-093770

(51) Int. Cl.

| | |
|---|---|
| ***H04R 25/00*** | (2006.01) |
| ***H04R 1/10*** | (2006.01) |
| *H04R 17/00* | (2006.01) |
| *H04R 25/02* | (2006.01) |

(52) U.S. Cl.
CPC ..... *H04R 25/606* (2013.01); *H04R 1/1016* (2013.01); *H04R 1/1041* (2013.01); *H04R 17/005* (2013.01); *H04R 17/00* (2013.01); *H04R 25/02* (2013.01); *H04R 2225/025* (2013.01);
(Continued)

(58) Field of Classification Search
CPC ... H04R 2460/13; H04R 25/606; H04R 17/00
See application file for complete search history.

(56) References Cited

U.S. PATENT DOCUMENTS

| | | | |
|---|---|---|---|
| 6,944,307 | B2 | 9/2005 | Berg |
| 8,331,593 | B2 | 12/2012 | Slemming et al. |
| 8,634,582 | B2 | 1/2014 | Nielsen |

(Continued)

FOREIGN PATENT DOCUMENTS

| | | | |
|---|---|---|---|
| JP | 2004-527931 | A | 9/2004 |
| JP | 2007-103989 | A | 4/2007 |

(Continued)

OTHER PUBLICATIONS

International Search Report issued in Application No. PCT/JP2014/002318, mailed Jun. 17, 2014.

(Continued)

*Primary Examiner* — Matthew Eason
(74) *Attorney, Agent, or Firm* — Studebaker & Brackett PC

(57) ABSTRACT

There is provided an acoustic device that can reduce muffled sound. The disclosed acoustic device includes a holder 103 that has one end abutting the inside of an inferior antihelix crus and other end abutting a depression between a tragus and an antitragus of a user's ear, and a human body vibration sound generator 10 that is held by the holder 103 and allows sound to be heard by the user in response to an audio signal as well.

13 Claims, 3 Drawing Sheets

(52) U.S. Cl.
CPC ..... *H04R 2430/01* (2013.01); *H04R 2460/09* (2013.01); *H04R 2460/13* (2013.01)

(56) References Cited

U.S. PATENT DOCUMENTS

| | | | | |
|---|---|---|---|---|
| 8,948,430 | B2 | 2/2015 | Nielsen | |
| 2004/0052389 | A1 | 3/2004 | Berg | |
| 2009/0092269 | A1 | 4/2009 | Nielsen et al. | |
| 2009/0180654 | A1 | 7/2009 | Nielsen | |
| 2009/0202094 | A1 | 8/2009 | Ammitzboll et al. | |
| 2009/0290730 | A1 | 11/2009 | Fukuda et al. | |
| 2009/0323993 | A1 | 12/2009 | Slemming et al. | |
| 2010/0202643 | A1 | 8/2010 | Nielsen | |
| 2010/0298626 | A1* | 11/2010 | Andersson ..... | H04R 17/00 600/25 |
| 2013/0148838 | A1* | 6/2013 | Silvestri ..... | H04R 1/1016 381/380 |

FOREIGN PATENT DOCUMENTS

| | | | |
|---|---|---|---|
| JP | 2007-165938 | A | 6/2007 |
| JP | 2009-542056 | A | 11/2009 |
| JP | 2012-257049 | A | 12/2012 |
| WO | 2008/029515 | A1 | 3/2008 |

OTHER PUBLICATIONS

Written Opinion issued in Application No. PCT/JP2014/002318, mailed Jun. 17, 2014.

* cited by examiner

ACOUSTIC DEVICE

CROSS-REFERENCE TO RELATED APPLICATION

This application claims priority to and the benefit of Japanese Patent Application No. 2013-093770 filed on Apr. 26, 2013, the entire contents of which are incorporated herein by reference.

TECHNICAL FIELD

This disclosure relates to an acoustic device such as an earphone, a hearing aid, or the like.

BACKGROUND

An acoustic device such as a prior inner-type earphone, or the like, was needed to be held by inserting a horn portion of a speaker thereof into an external ear canal.

SUMMARY

Technical Problem

However, the inner-type earphone is inserted into an external ear canal, thus it may shut out the outside sound and cause muffled sound when the earphone is mounted.

Therefore, this disclosure has been conceived in light of these circumstances, and it is an object of this disclosure to provide an acoustic device that is less likely to cause muffled sound.

Solution to Problem

The disclosed acoustic device includes a holder that has one end abutting the inside of an inferior antihelix crus and other end abutting a depression between a tragus and an antitragus of a user's ear, and a human body vibration sound generator that is held by the holder and allows sound to be heard by the user in response to an audio signal.

Furthermore, in the disclosed acoustic device, the human body vibration sound generator includes a vibrator having a piezoelectric element and a panel that is bent by the piezoelectric element, and vibration is transmitted from the panel to the user's ear.

Moreover, in the disclosed acoustic device, the vibrator abuts the user's tragus from the inside of the user's ear to transmit the vibration to the tragus, thereby allowing the human body vibration sound to be heard by the user.

Furthermore, in the disclosed acoustic device, the vibrator abuts the user's antitragus from the inside of the user's ear to transmit the vibration to the antitragus, thereby allowing the human body vibration sound to be heard by the user.

Moreover, in the disclosed acoustic device, the direction in which the panel of the vibrator bends and the direction in which the holder bends occurring when the holder is mounted on the user's ear are different from each other.

Furthermore, in the disclosed acoustic device, the external ear canal of the user is not sealed by the acoustic device.

Moreover, in the disclosed acoustic device, the panel vibrates with its center being an antinode of the vibration and both sides of the antinode being nodes, and the vicinity of the center of the panel abuts the tragus.

Furthermore, in the disclosed acoustic device, the panel vibrates with its center being an antinode of the vibration and both sides of the antinode being nodes, and the vicinity of the center of the panel abuts the antitragus.

Moreover, in the disclosed acoustic device, the vibrator abuts the user's tragus from the outside of the user's ear to transmit the vibration to the tragus, thereby allowing human body vibrating sound to be heard by the user.

Furthermore, in the disclosed acoustic device, the vibrator abuts the user's antitragus from the outside of the user's ear to transmit the vibration to the antitragus, thereby allowing human body vibration sound to be heard by the user.

Moreover, the disclosed acoustic device further includes a microphone.

Furthermore, in the disclosed acoustic device, the vibrator generates external ear canal radiation sound inside the user's ear.

Moreover, in the disclosed acoustic device, the vibrator is pressed against the user's ear with a force from 0.1N to 3N.

Furthermore, in the disclosed acoustic device, the piezoelectric element has a plate shape, and the panel has an area of 0.8 to 10 times the area of the main surface of the piezoelectric element.

Advantageous Effect

The disclosed acoustic device can provide an acoustic device with a high transmission efficiency.

DETAILED DESCRIPTION

The following describes one embodiment of this disclosure.

Embodiment

Figure 1:
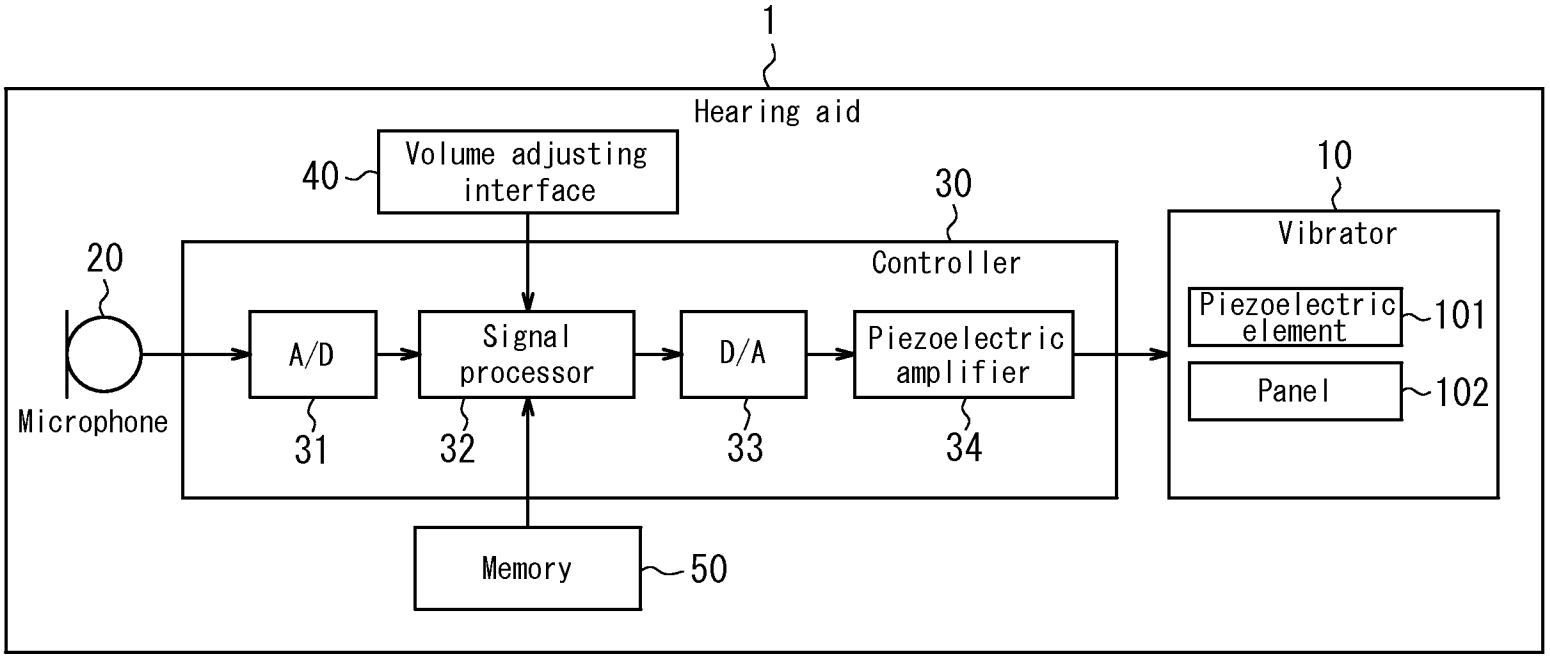
FIG. 1 is a block diagram illustrating a hearing aid according to one embodiment of this disclosure.

FIG. 1 is a block diagram illustrating an acoustic device 1 according to one embodiment of this disclosure. The acoustic device 1 is a hearing aid 1, for example, and includes a vibrator (human body vibration sound generator) 10, a microphone 20, a controller 30, a volume adjusting interface 40 and a memory 50.

The acoustic device 1 is roughly divided into two parts, such as the vibrator 10 and the holder held by an ear, and the microphone 20 and the controller 30 disposed in a housing. The housing in which the microphone 20 and the controller 30 are disposed may be put in a chest pocket, for example, to carry with, or may be held by an upper arm with a rubber band, or the like, which is a separate member.

Figure 2:
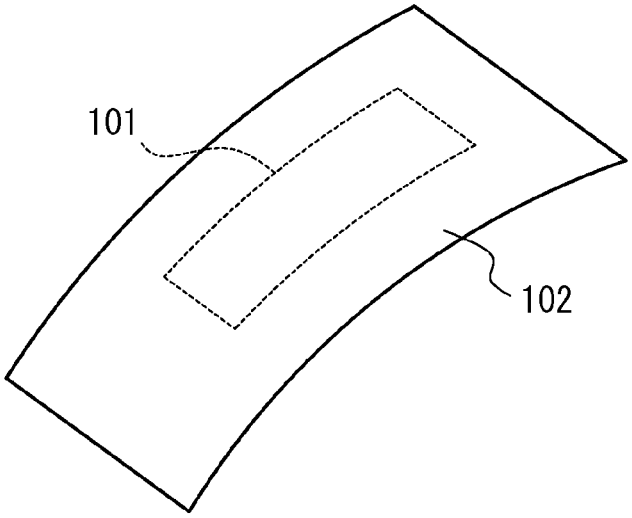
FIG. 2 is a schematic diagram illustrating bend of a panel and a piezoelectric element of the hearing aid according to one embodiment of this disclosure.

The vibrator 10 includes a piezoelectric element 101 that bends and a panel 102 that is directly bent by the piezoelectric element 101 and vibrates. FIG. 2 schematically illustrates a state where the panel 102 is bent by the piezoelectric element 101. The vibrator 10 may allow at least air conduction sound caused by vibration (radiation sound in external ear canal) and human body vibration sound to be heard by the user. The radiation sound in external ear canal is the sound transmitted to the user's auditory nerve when vibration of the air caused by vibration of human body is transmitted to the eardrum through the external ear canal and the eardrum is vibrated thereby. The human body vibration sound is the sound transmitted to the user's auditory nerve through a portion (such as the cartilage of the external ear) of the user's body being in contact with a vibrating object. Note that, depending on the area of the panel 102, normal air conduction sound generated when the air is pat by the surface of the panel may be generated.

The piezoelectric element 101 is an element that expands and contracts or bends based on the electro-mechanical coupling coefficient of the component material when an electrical signal (voltage) is applied. This element is made of, for example, ceramic or crystal. The piezoelectric element 101 may be a unimorph, a bimorph, or a stacked piezoelectric element. The stacked piezoelectric element includes a stacked unimorph element formed by stacking unimorph layers (e.g. 16 or 24 layers are stacked) or a stacked bimorph element formed by stacking bimorph layers (e.g. 16 or 24 layers are stacked). The stacked piezoelectric element is formed of a stacked structure of, for example, a plurality of dielectric layers made from PZT (lead zirconate titanate) and electrode layers disposed between the plurality of dielectric layers. A unimorph element expands and contracts when an electrical signal (voltage) is applied and a bimorph element bends when an electrical signal (voltage) is applied.

The panel 102 is formed of synthetic resin such as, for example, glass, acrylic, or the like. The panel 102 is preferably in the form of plate, and the following description is given assuming that the panel is in the form of plate.

The microphone 20 collects sound from a sound source, specifically the sound that arrives at the user's ear.

The controller 30 performs various controls related to the hearing aid 1. The controller 30 applies a predetermined electrical signal (a voltage corresponding to an audio signal) to the piezoelectric element 101. More specifically, in the controller 30, the audio signal collected by the microphone 20 is converted to a digital signal by an analog-digital converter 31. Then a signal processor 32 outputs a digital signal that drives the vibrator 10 based on the information related to the volume by the volume adjusting interface 40 and the information stored in the memory 50. A digital-analog converter 33 converts the digital signal to an analog electrical signal, which is amplified by a piezoelectric amplifier 34 and is applied to the piezoelectric element 101.

The voltage applied by the controller 30 to the piezoelectric element 101 may be ±15V or ±30V, which is higher than the voltage of ±5V applied to a panel speaker, or the like, of a so-called mobile electronic device, for transmitting sound via the air conduction, not via the human body vibration. Of course the audio device may have necessary power sources.

Thus the panel 102 generates a sufficient vibration, and human body vibration sound transmitted through a portion of the user's body can be generated. Note that the level of the applied voltage can be appropriately adjusted corresponding to the fixing strength of the panel 102 or the function of the piezoelectric element 101. When the controller 30 applies an electrical signal to the piezoelectric element 101, the piezoelectric element 101 expands and contracts or bends in the longitudinal direction.

At this time, the panel 102 to which the piezoelectric element 101 is attached deforms along with expansion/contraction or bend of the piezoelectric element 101 and vibrates. The panel 102 is bent by expansion/contraction or bend of the piezoelectric element 101. The panel 102 is directly bent by the piezoelectric element 101. Here, "the panel 102 is directly bent by the piezoelectric element 101" is different from a phenomenon in which the panel 102 deforms when its specific region is vibrated by the inertial force of a piezoelectric actuator formed by disposing the piezoelectric element 101 in a casing, which has been adopted by prior panel speakers. "The panel 102 is directly bent by the piezoelectric element 101" means that, as illustrated in FIG. 2, expansion/contraction or bend (curve) of the piezoelectric element 101 directly bends the panel 102 through a joining member.

The main surface of the panel 102 has an area which is from 0.8 to 10 times the area of the main surface of the piezoelectric element 101. If the main surface of the panel 102 is from 0.8 to 10 times the area of the piezoelectric element 101, it can deform along with expansion/contraction or bend of the piezoelectric element 101, and a sufficient area to be in contact with the user's ear can be secured. Note that, more preferably the area of the panel is, for example, from 0.8 to 5 times the area of the piezoelectric element.

As described above, in the hearing aid 1 according to one embodiment of this disclosure, the microphone 20 collects sound from the sound source, and the vibrator 10 causes the panel 102 to vibrate, thereby allowing the sound collected by the microphone 20 to be heard by the user. The panel 102 vibrates, thus generates air conduction sound including radiation sound in external ear canal and, when the user brings his/her tragus contact therewith, generates human body vibration sound transmitted through the tragus as well. Preferably the panel 102 vibrates by using the vicinity of its center as an antinode and both sides of the antinode as nodes, and the vicinity of the center of the panel abuts the tragus or the antitragus. Thus vibration of the panel 102 can be transmitted to the tragus or the antitragus efficiently.

Figure 3:
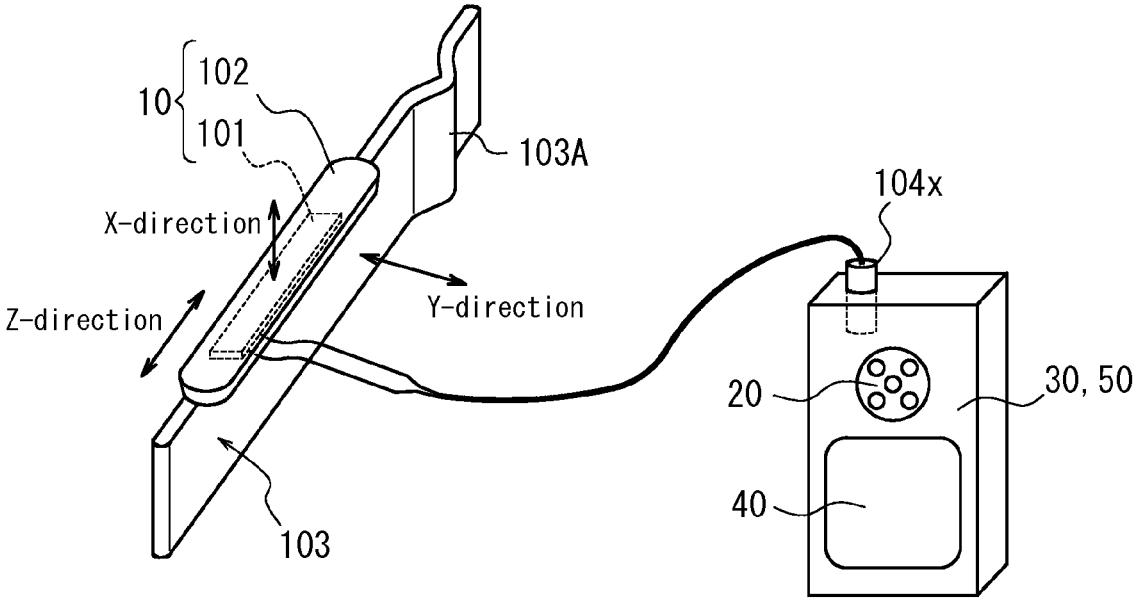
FIG. 3 is a diagram illustrating an external view of the hearing aid.

FIG. 3 is a schematic diagram illustrating a structure of the hearing aid 1 according to one embodiment of this disclosure. As illustrated in FIG. 3, the hearing aid 1 includes the vibrator 10 and the holder 103. Then the vibrator 10 has the piezoelectric element 101 and the panel 102. The vibrator 10 is formed of a long plate to allow the panel 102 to abut the ear. For example, when the vibrator 10 is formed of acrylic molding, it is about 0.5 mm to 2.5 mm thick, about 0.8 cm to 2.5 cm long in the longitudinal direction and about 0.4 mm to 1.2 mm width. Then, the piezoelectric element 101 is attached to the face on the side of the panel 102, which does not abut the ear, with a joining member such as a double-sided tape or the like. The joining member may be non-heated type curable adhesive or a double-sided tape. Further, a lead wire 104 is drawn from a portion of the piezoelectric element 101 and is connected to the controller 30. The tip of the lead wire may be a connector jack 104*x* having a standardized shape so that it is applicable to the applications other than the hearing aid, thereby allowing connection to various electronic devices.

The vibrator 10 is mounted on the holder 103 formed of a long plate member approximately along the Z-direction. The holder 103 has, at a predetermined position from one end thereof, a curved portion 103A that bends (toward the Y-direction) from the main surface of the plate in a protruding manner. Then, a plate portion 103B formed in a plate shape extends from the curved portion 103A toward the other end (along the Z-direction).

The holder 103 can be made easily by resin molding such as acrylic resin, for example. The holder is approximately from 2.6 cm to 3.5 cm long in the longitudinal direction (Z-direction). Further, the holder may have a width (X-direction) and a thickness (Y-direction) that is sufficient to cause the user no pain during its long hours use when it is held by the user's ear and to allow for holding of a hearing aid itself with an appropriate pressing against the user's ear. For example, the width may be about from 4 mm to 12 mm and the thickness may be about from 1.5 mm to 2.5 mm. Note that, in this embodiment, the controller 30 and the microphone 20 are provided as a separate member, thus the holder 103 may hold only the vibrator 10 and the holder 103 itself.

Further, on the side wall of the holder 103, the vibrator 10 is attached to a position intersecting with the main surface of the holder 103 along the Z-direction. The vibrator 10 may be attached to the holder 103 by, for example, attaching the panel 102 of the vibrator 10 to the holder 103 with adhesive. Alternatively, the vibrator 10 may be attached to the holder 103 on the opposite side of the panel 102 to which the piezoelectric element 101 is attached with a double-sided tape, adhesive, or the like. Note that the vibration of the antinode can be less disturbed by attaching the holder substantially the nodes of the vibrator 10 illustrated in FIG. 2, decreasing the attaching force to the antinode or not attaching to the antinode. Note that, when a double-sided tape, or the like, has enough flexibility, an adhesive region may be provided on substantially entire surface of the piezoelectric element 101. They are appropriately adjusted.

Figure 4:
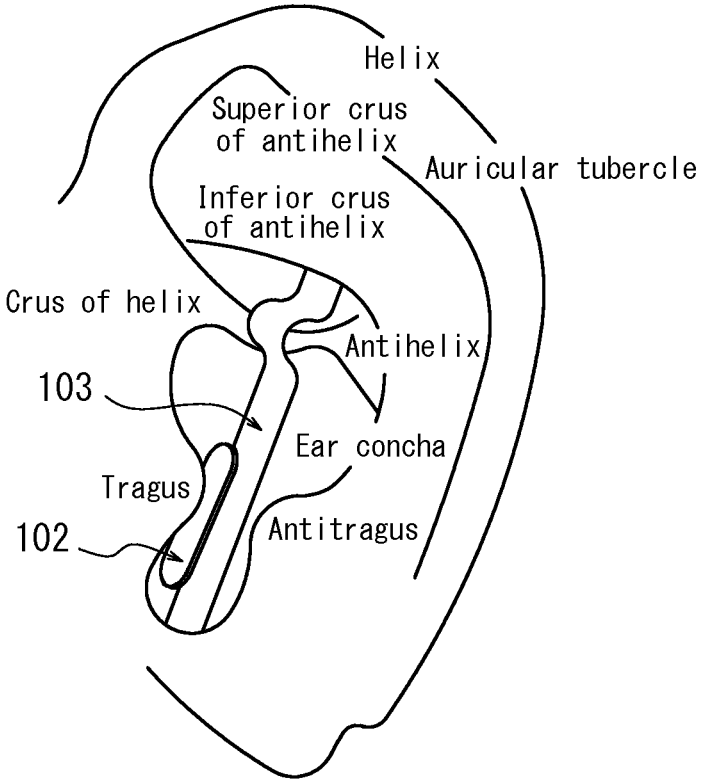
FIG. 4 is a diagram illustrating a state where the hearing aid is mounted on the user's ear.

As illustrated in FIG. 4, the hearing aid 1 according to this embodiment allows the vibrator 10 to abut the user's tragus or antitragus from the inside of the user's ear to transmit vibration to the tragus or the antitragus, thereby allowing the sound to be heard by the user. Here, "allows the vibrator 10 to abut the user's tragus or antitragus from the inside of the user's ear" means that, when the vibrator 10 is embedded in the external ear canal, it abuts the tragus or the antitragus from the vicinity of the entrance of the external ear canal. In the example illustrated in FIG. 4, the vibrator 10 abuts the user's tragus from the inside of the user's ear.

Preferably the vibrator 10 is pressed against the user's ear with a force from 0.1N to 3N. When the vibrator 10 is pressed in the range from 0.1N to 3N, vibration by the vibrator 10 is sufficiently transmitted to the ear. Further, when pressed with a small force of less than 3N, the user may have no feeling of fatigue when wearing the hearing aid 1 for a long period of time, thus comfort during wear can be maintained.

Further, as illustrated in FIG. 4, in the hearing aid 1 according to this disclosure, the external ear canal is not sealed by the vibrator 10 and the holder 103. Therefore the disclosed hearing aid 1 may cause no feeling of muffled sound, thus comfort during wear can be maintained.

In the hearing aid 1 according to this embodiment, one end of the holder 103 along the Z-direction goes into the back side of the inferior antihelix crus of the user's ear and butts against inside of the ear, and the other end of the holder 103 along the Z-direction passes through between the tragus and the antitragus and butts against the lower end of the user's ear. Thus the holder 103 is caught in the ear with its longitudinal direction (Z-direction) applied with a stress, and serves as a holder.

When the holder 103 is mounted on the user's ear, its main surface may be bent toward the Y-direction illustrated in FIG. 3 by the stress generated against the holder 103. Note that the direction of the bend of the panel 102 caused by the bend of the piezoelectric element 101 is the X-direction, which is different from the direction of the above-mentioned bend of the holder 103. Then, the stress caused by deformation of the piezoelectric element 101 to bend the panel 102 is received by the side of the holder 103, thus, for example, it is less likely that the holder 103 is bent by the bend of the panel 102, and the transmission energy is less likely to be dissipated. Thus an acoustic device such as a hearing aid or the like that is less likely to cause decrease in transmission efficiency of vibration can be provided.

The panel 102 of the vibrator 10 is held in a manner as described above, thus abuts the user's tragus from the inside of his/her ear. Then, the panel 102 bends against the tragus and vibrates, thereby allowing for transmission of vibration to the tissue of the user's ear around its tragus.

Further, in the curved portion 103A of the holder 103, the region opposed to the swell of the crus of helix is bent to prevent the holder 103 from pressing the crus of helix of the user's ear too much or to avoid abutting the crus of helix as much as possible. Such a structure is effective for long hours of wear.

Note that this embodiment describes an example where the acoustic device is the hearing aid 1, but it is not limited thereto. For example, the acoustic device may be a headphone or an earphone, and in this case, the microphone 20 for collecting ambient sound may not be needed. Further, in this case, the sound based on the music data stored in the memory inside of the acoustic device or the sound based on the music data stored in an external server or the like may be reproduced by the acoustic device through the network.

Note that, although this embodiment describes an example where the vibrator 10 is allowed to abut the user's tragus from inside of the user's ear to transmit vibration to the tragus, thereby allowing the sound to be heard by the user, it is not limited thereto. For example, the vibrator 10 may be allowed to abut the user's antitragus from the inside of the user's ear to transmit vibration to the antitragus, thereby allowing the sound to be heard by the user, or the vibrator 10 may be allowed to abut the user's tragus or antitragus from the outside of the user's ear to transmit vibration to the tragus or the antitragus, thereby allowing the sound to be heard by the user. Note that "allowed to abut the user's tragus or antitragus from the outside of the user's ear" means that the vibrator 10 is not embedded in the external ear canal, and is allowed to abut the tragus or the antitragus in approximately parallel with the cheek or the temple.

Alternatively, in the above described embodiment, an acoustic device in which sound is heard by transmitting vibration has been described. However, instead of the vibrator 10, or with the vibrator 10, a sound generator that generates air conduction sound may be held by the holder 103.

Further, sound transmission technology is not limited to those by vibration, and a so-called dynamic-type speaker that generates air conduction sound may be held by the holder 103. Even in this case, a holding structure does not block the external ear canal, thus it is less likely to cause muffled sound.

Although this disclosure has been described with reference to the accompanying drawings and embodiment, it is to be noted that various changes and modifications will be easily made by those skilled in the art based on this disclosure. Therefore, these changes and modifications are included in the scope of this disclosure. For example, the functions or the like included in each means, each member, or the like, that are disclosed herein may be reordered in any logically consistent way, and a plurality of means, members, or the like, may be combined into one or divided.

REFERENCE SIGNS LIST

1: Acoustic device (Hearing aid)

10: Human body vibration sound generator (Vibrator)

20: Microphone
30: Controller
31: Analog-digital converter
32: Signal processor
33: Digital-analog converter
34: Piezoelectric amplifier
40: Volume adjusting interface
50: Memory
101: Piezoelectric element
102: Panel
103: Holder

The invention claimed is:

1. An acoustic device, comprising:

a holder that has one end abutting inside of an inferior antihelix crus and other end abutting a depression between a tragus and an antitragus of a user's ear; and a human body vibration sound generator that is held by the holder and allows sound to be heard by the user in response to an audio signal, wherein the human body vibration sound generator comprises a vibrator that includes a piezoelectric element and a panel that is bent by the piezoelectric element, and vibration is transmitted from the panel to the user's ear, wherein the piezoelectric element and the panel are mounted to the holder, and wherein the piezoelectric element, the panel and the holder are configured to fit inside a space defined by the inferior antihelix crus on the one end and the depression between the tragus and the antitragus at the other end.

2. The acoustic device according to claim 1, wherein the vibrator abuts the user's tragus from inside of the user's ear to transmit the vibration to the tragus, thereby allowing human body vibration sound to be heard by the user.

3. The acoustic device according to claim 1, wherein the vibrator abuts the user's antitragus from inside of the user's ear to transmit the vibration to the antitragus, thereby allowing the human body vibration sound to be heard by the user.

4. The acoustic device according to claim 1, wherein a direction in which the panel of the vibrator bends and a direction in which the holder bends occurring when the holder is mounted on the user's ear are different from each other.

5. The acoustic device according to claim 1, wherein an external ear canal is not sealed by the acoustic device.

6. An acoustic device, comprising:

a holder that has one end abutting inside of an inferior antihelix crus and other end abutting a depression between a tragus and an antitragus of a user's ear; and a human body vibration sound generator that is held by the holder and allows sound to be heard by the user in response to an audio signal, wherein the human body vibration sound generator comprises a vibrator that includes a piezoelectric element and a panel that is bent by the piezoelectric element, and vibration is transmitted from the panel to the user's ear, wherein the vibrator abuts the user's tragus from inside of the user's ear to transmit the vibration to the tragus, thereby allowing human body vibration sound to be heard by the user, and wherein the panel vibrates with its center being an antinode of the vibration and both sides of the antinode being nodes, and vicinity of the center of the panel abuts the tragus.

7. An acoustic device, comprising:

a holder that has one end abutting inside of an inferior antihelix crus and other end abutting a depression between a tragus and an antitragus of a user's ear; and a human body vibration sound generator that is held by the holder and allows sound to be heard by the user in response to an audio signal, wherein the human body vibration sound generator comprises a vibrator that includes a piezoelectric element and a panel that is bent by the piezoelectric element, and vibration is transmitted from the panel to the user's ear, wherein the vibrator abuts the user's antitragus from inside of the user's ear to transmit the vibration to the antitragus, thereby allowing the human body vibration sound to be heard by the user, and wherein the panel vibrates with its center being an antinode of the vibration and both sides of the antinode being nodes, and vicinity of the center of the panel abuts the antitragus.

8. The acoustic device according to claim 1, wherein the vibrator abuts the user's tragus from outside of the user's ear to transmit the vibration to the tragus, thereby allowing human body vibration sound to be heard by the user.

9. The acoustic device according to claim 1, wherein the vibrator abuts the user's antitragus from outside of the user's ear to transmit the vibration to the antitragus, thereby allowing human body vibration sound to be heard by the user.

10. The acoustic device according to claim 1, wherein external ear canal radiation sound is generated in the user's ear by the vibrator.

11. The acoustic device according to claim 1, wherein the vibrator is pressed against the user's ear with a force from 0.1N to 3N.

12. The acoustic device according to claim 1, wherein the piezoelectric element has a plate shape, and an area of the panel is from 0.8 to 10 times an area of a main surface of the piezoelectric element.

13. The acoustic device according to claim 1, further comprising a microphone.

* * * * *